United States Patent [19]

Suthanthiran

[11] Patent Number: 4,905,346

[45] Date of Patent: Mar. 6, 1990

[54] HANDLE MECHANISM

[75] Inventor: Krishnan Suthanthiran, Lorton, Va.

[73] Assignee: Best Industries, Inc., Springfield, Va.

[21] Appl. No.: 228,008

[22] Filed: Aug. 3, 1988

Related U.S. Application Data

[62] Division of Ser. No. 115,930, Nov. 2, 1987, Pat. No. 4,847,505.

[51] Int. Cl.[4] ..... B25G 1/04; B65D 23/10

[52] U.S. Cl. ..... 16/115

[58] Field of Search ..... 16/115; 220/94 R

[56] References Cited

U.S. PATENT DOCUMENTS

| | | | |
|---|---|---|---|
| 1,220,975 | 3/1917 | Gemeinder . | |
| 2,047,485 | 7/1936 | McBrady . | |
| 3,187,937 | 6/1965 | Berta | 220/94 R |
| 3,522,955 | 8/1970 | Warner . | |
| 3,981,044 | 9/1976 | Luebke et al. . | |

FOREIGN PATENT DOCUMENTS

| | | | |
|---|---|---|---|
| 795560 | 5/1958 | United Kingdom | 16/115 |

*Primary Examiner*—Nicholas P. Godici
*Assistant Examiner*—Carmine Cuda
*Attorney, Agent, or Firm*—Arnold, White & Durkee

[57] ABSTRACT

A storage and transport container for radioactive medical materials comprising a stainless steel shell with a central stainless steel well opening downwardly from the top of the container with a multiplicity of small diameter, generally U-shaped stainless steel tubes, one end of each such tube extending out of each side of the stainless steel shell, the bottom of the U-portion of each tube passing under the central well. Where the container is substantially cylindrical, the well and stainless steel tubes may extend substantially through the length of the shell. The wells of the containers are stoppered or sealed with a plug of radiation shielding material. A novel handle structure for such containers comprises a vertical shaft connected to the container by a short open sleeve attached near the top of one side of the container so that the shaft may move upwardly and downwardly in the sleeve and rotate therein. The top of the shaft has a horizontal handle extending therefrom and the opposite side of the bottom of the shaft has a pin extending outwardly therefrom, which pin is engageable with a locking groove in the sleeve which retains and orients the handle with respect to the container when the handle is in the raised position.

2 Claims, 10 Drawing Sheets

HANDLE MECHANISM

This is a division of Ser. No. 115,930, filed 11/2/87, now U.S. Pat. No. 4,847,505.

BACKGROUND

The present invention relates to storage and transport containers for radioactive materials used for medical treatments, including a novel handle structure for such containers.

While there are a variety of ways in which radioactive materials may be used in various medical treatment applications, in one such treatment application small pellet-like seeds which comprise radioactive material are arranged in a spaced relationship along the length of a ribbon-like member, which ribbon-like member may be cut to any desired length and inserted into a catheter-like surgical tube or needle which is inserted into body tissue to accommodate such implantations of radioactive treatment materials. Such so-called ribbons of radioactive seeds are constructed, in at least one embodiment, by placing pellet-like seeds comprising radioactive material with or without alternate spacing material within a small flexible tube, such as a tube of nylon or teflon plastic material. Those inserts are sufficiently tightly fitting within the tubular envelope that when complete the pellets and spacers maintain their positions within the tube which then has a symmetrically spaced ribbon-like appearance, any desired length of which may be cut and implanted for radioactive medical treatment purposes.

However, it will be appreciated that such radioactive materials must be handled in containers which protect both patients and medical personnel administering such materials to patients. Furthermore, such materials must be safely packaged for transport from manufacturer to distributor to end user, and even within the facility of an end user such as a hospital. It is for the safe storage and transportation of such ribbons of radioactive medical treatment materials that the advantageous storage and transport containers of the present invention are particularly suited.

Containers or vessels for the storage and transportation of radioactive materials such as radioactive waste or radioactive fuel elements associated with nuclear power generation are known in the art as disclosed in Baatz U.S. Pat. No. 4,626,402; Kugeler U.S. Pat. No. 4,634,875 and Waltersdorf U.S. Pat. No. 4,649,018. However, the particular problems associated with storage and transportation of ribbons of seed-like radioactive pellets useful in medical treatment are quite distinctly different from many of the problems encountered in storage or transportation of nuclear fuel elements or waste resulting therefrom.

Some devices for containing and exposing a capsule of radioactive material are known as disclosed in Meilink U.S. Pat. No. 2,862,108, and devices for applying therapeutic radiation originating from elongate lengths of beads or seeds of radioactive material which are located in passages within the device are known, as disclosed in Tokita U.S. Pat. No. 4,584,991. Furthermore, the assignee of the present invention has previously marketed containers for ribbons of medical dosages of radioactive materials, which containers first comprised a block of solid lead having a copper tube extending therethrough in which ribbons containing radioactive seeds could be stored and transported. Applicant later marketed a container comprising a stainless steel outer cylinder filled with solid lead and having a central tube and stainless steel carrier tubes extending through the length of the lead-filled cylinder. In one such embodiment the stainless steel tubes extended through the entire length of the lead filling having open exits at each end of the cylinder, with each such tube being marked with distinguishing indicia. Additionally, in that embodiment the open ended stainless steel tubes took a spiral path from one end of the container to the other about the central tube. In another somewhat similar embodiment, the stainless steel tubes were straight and terminated near one end of the lead filled cylinder which termination location was filled with a lead plug, while the other ends of the tubes were closed by a stainless steel plug. However, even those prior devices of the present applicant suffered disadvantages which are overcome by the invention disclosed and claimed herein.

The present invention also includes a unique retractable handle structure for the inventive storage and transportation containers for medical radioactive materials. While various retractable handles for various different articles and receptacles have been known in the art, as disclosed for example in Luebke U.S. Pat. No. 3,981,044; Gemeinder U.S. Pat. No. 1,220,975; McBrady U.S. Pat. No. 2,047,485 and Warner U.S. Pat. No. 3,522,955, the unique handle system of the present invention provides a structure and advantages which are different from and improvements over any presently known handle structure.

However, all of the foregoing prior methods of storing and transporting radioactive materials have substantial shortcomings, including the structure and manner in which handles are used in conjunction with such containers. In particular, such prior art structures and methods did not adequately address the safety issues involved in the storage and transportation of radioactive materials for medical purposes, and do not have adequate handle structures to provide proper safety and efficient storage of such containers.

SUMMARY OF THE INVENTION

Accordingly, it is an object of the present invention to provide a new and useful storage and transport container for radioactive medical materials and to provide such a container which overcomes the shortcomings of the prior art.

It is an object of the present invention to provide such a container which increases the safety provided by such containers in storing and transferring radioactive medical materials.

It is another object of this invention to provide a storage and transport container for radioactive medical materials which facilitates minimizing exposure time of such materials to personnel who must handle such radioactive materials.

It is a further object of the present invention to provide a storage and transport container for radioactive medical materials which more clearly identifies each ribbon of radioactive material therein and facilitates use and calibration of each individual ribbon therein.

It is still a further object of the present invention to provide an improved container for storage, transfer and disposal of waste, used or unused seeds or ribbons of radioactive medical materials.

It is still a further object of the present invention to provide such storage and transport containers for radioactive materials, including such containers having a retractable handle, which containers may be more efficiently packed and stored in smaller storage spaces.

It is still another object of the present invention to provide storage and transport containers for radioactive medical materials which are substantially easier to handle because of their lesser weight while providing even more safety from radiation.

It is yet another object of the present invention to provide a unique retractable handle structure which may be used for any container or object, and particularly such a handle structure for containers for storage and transport of radioactive medical materials.

The foregoing objects and others are achieved by providing a storage and transport container comprising a stainless steel shell having a cross-sectional shape in the form of a rectangle with rounded corners or a circle, with a central stainless steel well opening downwardly from the top of the container with a multiplicity of small diameter stainless steel tubes being generally U-shaped with one end of each such tube extending out of one lateral side of the stainless steel shell and the other end of each such tube extending out of the opposite side of the stainless steel shell, the bottom of the U-portion of each tube passing under the central well. Where the container is substantially cylindrical, the well may extend substantially through the length of the shell and the stainless steel tubes also extend throughout the length of the shell parallel to and adjacent the wall of the well between the outer shell and the wall of the well, and such tubes have an outward bend near each end to eliminate any direct radiation path from the interior of the tube through the end of the tube. The wells of the containers are stoppered or sealed with a plug formed of stainless steel, stainless steel covered lead, brass, or other suitable radiation shielding material. Where the containers are primarily for the transport of radioactive material, such wells may include a funnel-shaped entryway at the top of the container which is double plugged with a tungsten plug followed by a fitted brass plug/cap.

The novel handle structure for such containers comprises a vertical shaft whose length is substantially the same as the height of the container itself, that shaft being connected to the container by a short open sleeve attached near the top of one of the vertical sides of the container so that the shaft is closely fitted therein, but may move upwardly and downwardly in that sleeve and rotate therein. The top of the shaft has a horizontal handle member extending therefrom and the diametrically opposite side of the bottom of the shaft has a pin extending radially outward therefrom a short distance, which pin is engageable with a locking groove in the sleeve which retains the handle on the container for positively orienting the handle with respect to the container when the handle is in the raised position.

BRIEF DESCRIPTION OF THE DRAWINGS

For a better understanding of the structure, advantages and further features of the advantageous storage and transport containers of the present invention reference is made to the accompanying drawings of various embodiments thereof, wherein.

DETAILED DESCRIPTION OF THE INVENTION

Figure 1:
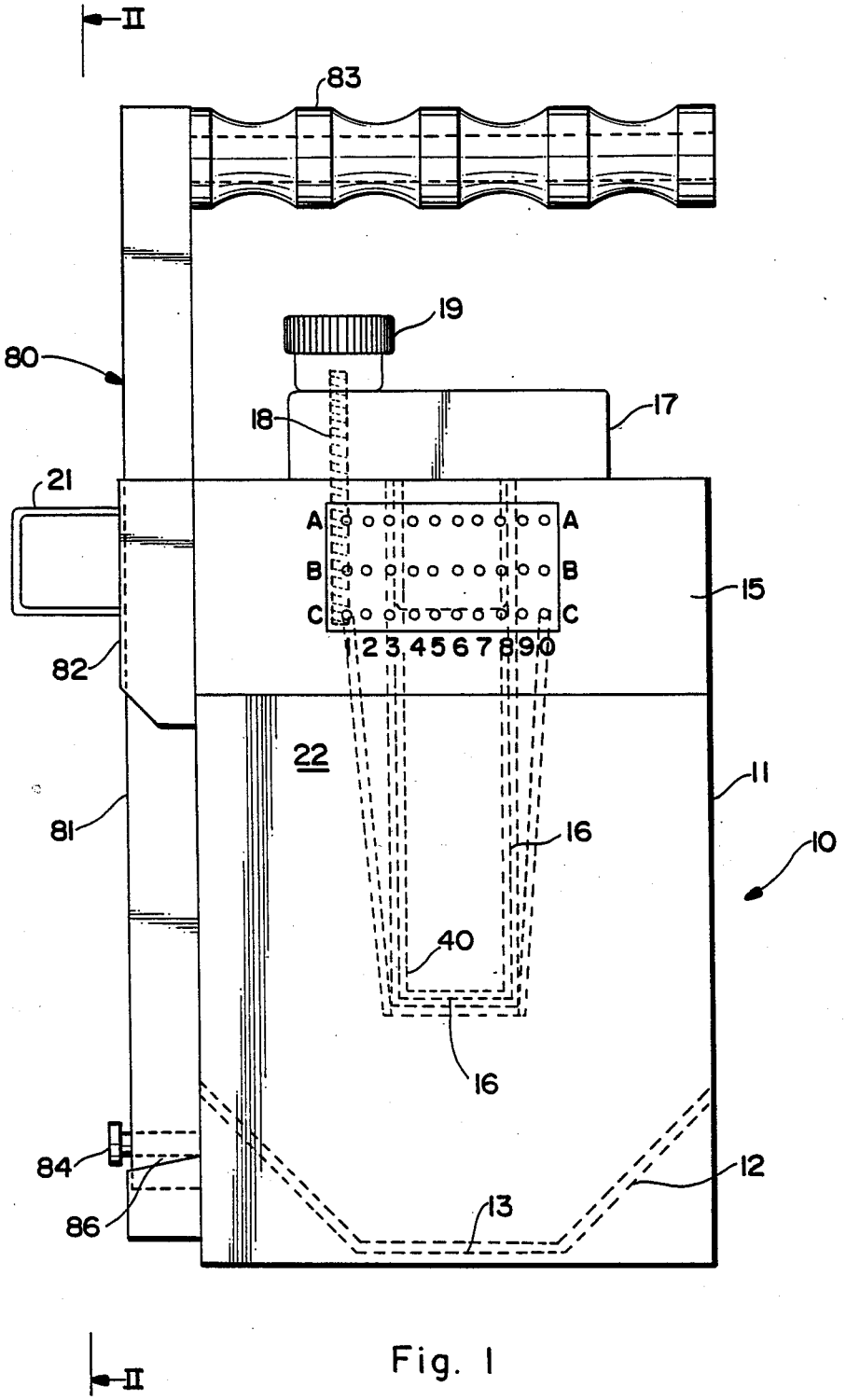
FIG. 1 is a partially schematic side view of a preferred embodiment of the inventive storage and transport container showing the spacial relationships between the exterior shell, internal well and exits of the multiple carrier tubes.
Figure 2:
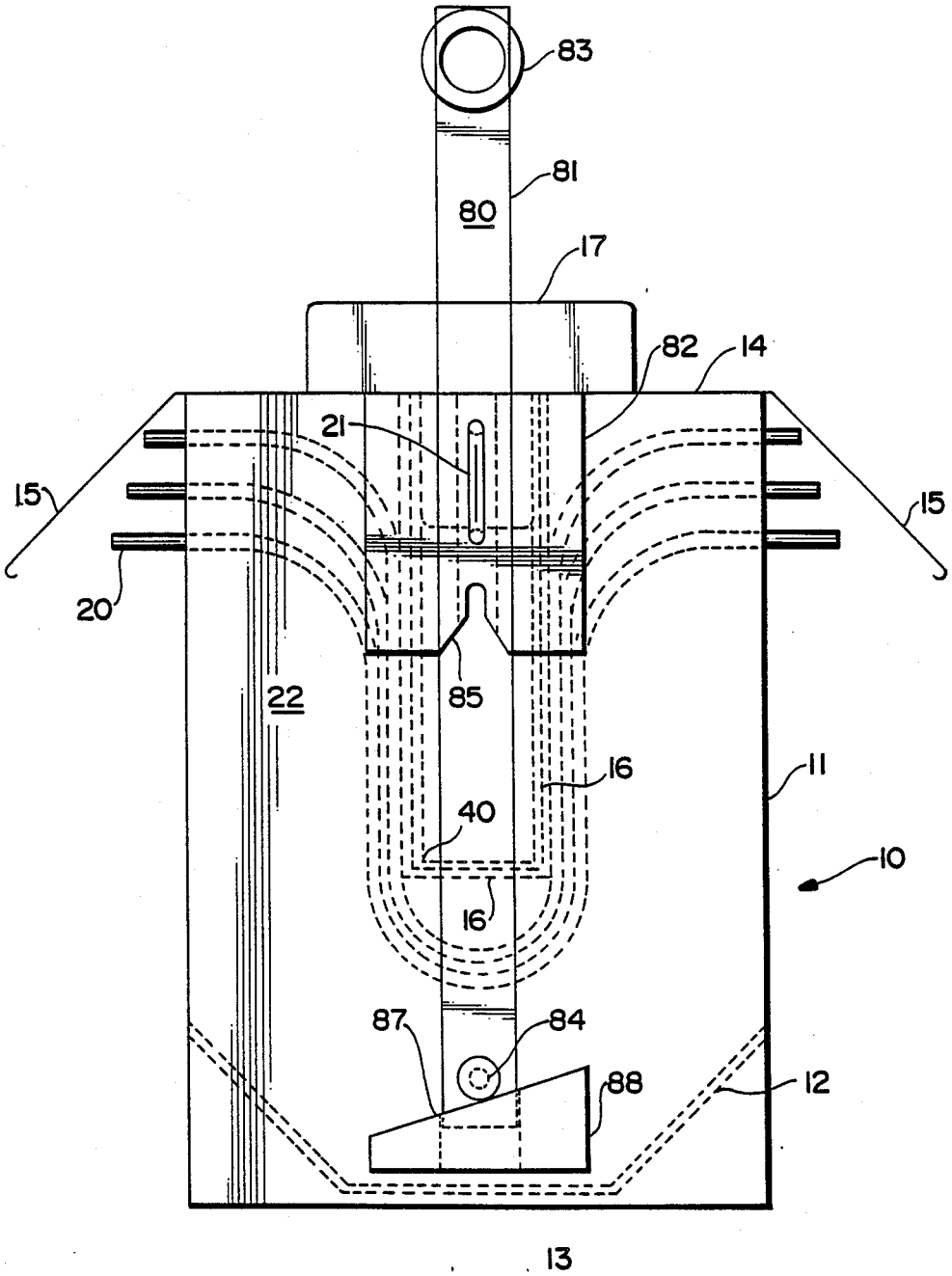
FIG. 2 is a partially schematic side view of the storage and transport container of FIG. 1, from the side to which the handle member is attached and showing the spatial relationships among the outer shell, inner well and stainless steel carrier tubes.
Figure 3:
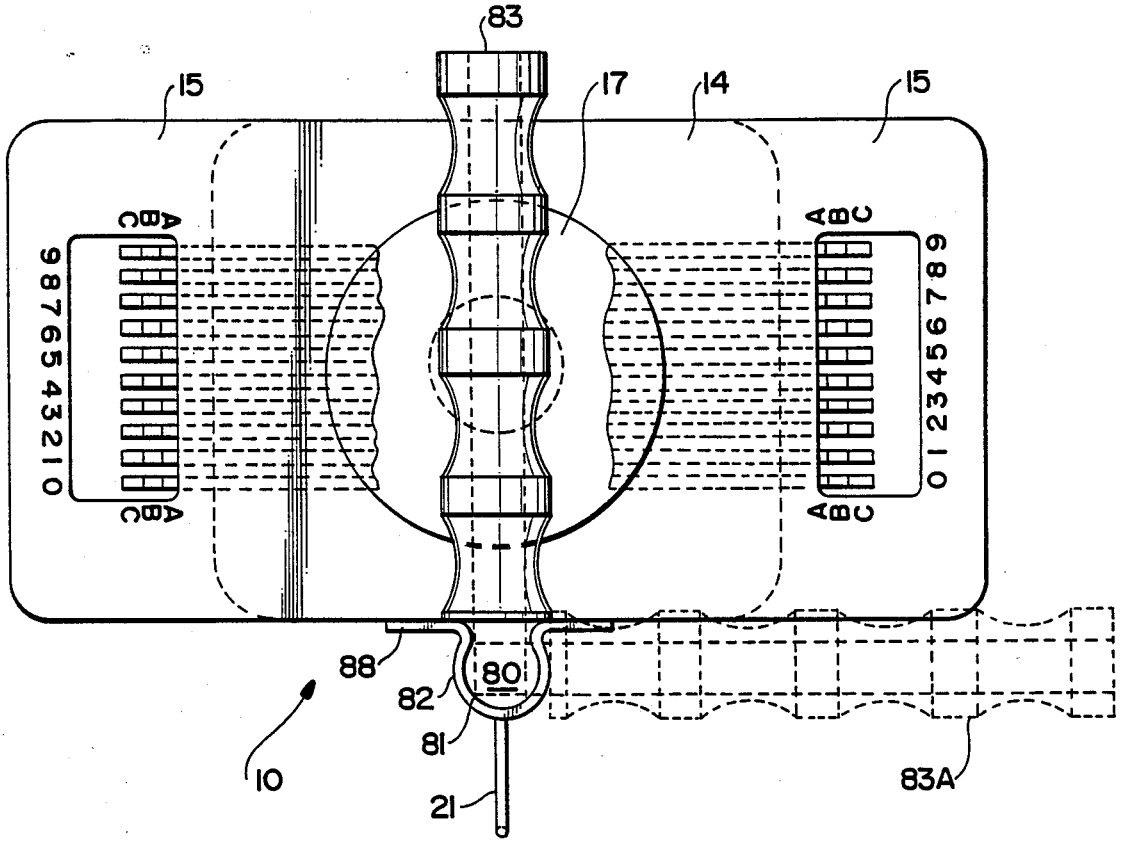
FIG. 3 is a partially schematic top view of the storage and transport container of the present invention as illustrated in FIGS. 1 and 2.

One preferred embodiment of the advantageous storage and transport containers of the present invention is illustrated in FIGS. 1–3 which show a container 10 which has a basically rectangular cross section, the corners of which are well rounded. The external shape of the container is formed by a shell 11 of stainless steel which provides rigidity for the container as a whole as well as shielding for the radioactive material to be stored and transported therein. The stainless steel side walls 11 extend throughout the height of the container, and a stainless steel bottom 12, 13 is shown welded within the generally rectangular shape of the bottom of the side shell 11 so that the portions of the bottom 12 which are adjacent each of the sides of the outer shell 11 extend obliquely upwardly from a lowermost point, which is not as low as the bottom edge of the side shell 11. Those angled portions are connected, for example by welding, to the side shell at a level substantially above the level of the bottom of the side shell material 11. For example, those angled portions of the bottom shell material made approximately 45° angles with both the side shell and the horizontal portion 13 of the container bottom. The bottom of the container as just described is formed from stainless steel sheet material of the same thickness as the sides 11. The top of the storage and transport container of the present invention is perhaps best illustrated in FIGS. 2 and 3 where it is seen that the sheet of stainless steel which forms the top not only covers the entire rectangular area of the top formed by the junction of the top 14 and the side walls 11, but also includes laterally and downwardly extending flap or overhang-like portions 15 which provide protection for the exposed portions of stainless steel carrier tubes 20 which extend through the container.

In the interior of the container is a stainless steel well or cavity 16 which is conveniently circular in cross section, which extends from the top surface of the container to a point below the center of the height of the container. That well is also formed of stainless steel. The top of that well is closed by an appropriate plug, for example a plug having a center of solid lead covered by an exterior shell of stainless steel. The plug 17 fits snugly within the top of the bore of cavity 16 and is secured in that position by a fixed threaded male screw shaft 18 secured in the top of container 10, which has a female threaded knob 19 on the top end thereof to firmly attach, or release, cap 17 from container 10. Additionally, the well or cavity 16 may include a complimentary internal plastic liner tube 40 with a closed bottom so that materials dropped into the well may easily be removed by simply removing the liner tube. Indeed, it is the purpose of the interior cavity or well to serve as a receptacle for used radioactive seeds or ribbon parts, or even unused portions of radioactive seeds or ribbons, so that such waste materials will be secured and stored in safety rather than being randomly discarded in circumstances which might expose persons to undesirable radiation.

The radiation shielding material, preferably stainless steel, of which the shell, top, bottom and central wall or cavity are formed is preferably of a thickness in the range of about 0.020 to about 0.25 inches thick.

As indicated earlier in this application, a primary purpose for the advantageous storage and transportation containers of the present invention is for storage and transportation of ribbon-like radioactive medical materials which are used in various applications for medial treatments of tumors and the like. Such ribbons comprise spaced radioactive seeds and may be used in varying lengths as required to control the dosage desired in the situation for a particular patient. It is of course important to transport such radioactive material in containers in circumstances which are as safe as possible so that neither the patient nor the personnel transporting, handling or administering the radioactive treatment material is unnecessarily exposed to radiation from such material. And indeed that safety is a primary object of the advantageous storage and transport containers of the present invention.

In the inventive containers the ribbons of radioactive material are individually housed in one of a plurality of small diameter stainless steel tubes which extend in a generally U-shape through the interior of the container. These tubes 20 are perhaps best illustrated in FIG. 2 wherein it is clear that one end of each tube 20 protrudes from one side of the container, under the flap or overhang portion 15, and each such tube then extends into the interior of the container, passing downwardly under the bottom of the well or cavity 16, rising upwardly on the opposite side of the well or cavity 16, and emerging again on the exterior of the opposite side surface 11 under the flap or overhang 15. The stainless steel carrier tubes 20 are arranged so that their ends exit from the interior of the container in a grid of ranks and files so that marking indicia on the exterior of the container can clearly identify each separate tube to facilitate record keeping and knowledge of the exact type and nature of the radioactive material ribbon stored in each such tube.

The carrier tubes 20 typically have diameters in the range of about 0.015 to about 0.50 inches.

As an additional feature of the present invention the exit portion of each such carrier tube 20 is fitted with a small length of rubber or plastic tubing to protect the ribbon of radioactive material stored therein from being crimped or cut by sharp bending over the extending end of the stainless steel tube 20. Additionally, the primary purpose of the flap or overhang members 15 is to protect the protruding ends of the carrier tubes 20 from being bent, crimped or otherwise damaged in the event that the container as a whole tips over, falls, or is otherwise strongly impacted by external objects. As illustrated in FIGS. 1 and 3, the flap portions 15 extending from the top of the container include an opening or window through which the ends of all of the stainless steel container tubes 20 are accessible, and the flap itself also bears alpha numeric indicia for uniquely identifying each of the stainless steel carrier tubes 20.

The inventive container also includes a handle structure, generally designated 80, which will be described in detail later herein. Additionally, extending outwardly on the same side of the container where the handle is attached is a loop or bracket which optionally may be used for holding any loose lead ends of ribbons containing radioactive material which may be stored in the container in order to maintain such loose lead ends of such ribbons in an organized fashion at a location where those ends will not be impaired by operation of the handle mechanism.

The interior 22 of the stainless steel shell 11 as further confined by the bottom 13, top 14 and internal cavity 16, is typically filled with solid lead which serves as a shield against penetration by radiation which eminates from the radioactive materials stored and transported in the stainless steel tubes 20 within the interior of the container of the present invention. Additionally, the lead filling within the interior 22 of the container serves to stabilize and fix the location of each of the stainless steel carrier tubes 20, which thus do not move within the interior of the container. Such lead filled containers are typically used for the storage and transportation of radioactive medical materials which are known to emit relatively high energy radiation. In other embodiments of the present invention, such lead filling may not be necessary, particularly where such containers are intended for storage and transportation of radioactive medical materials whose radiation is known to be of relatively low energy.

Figure 4:
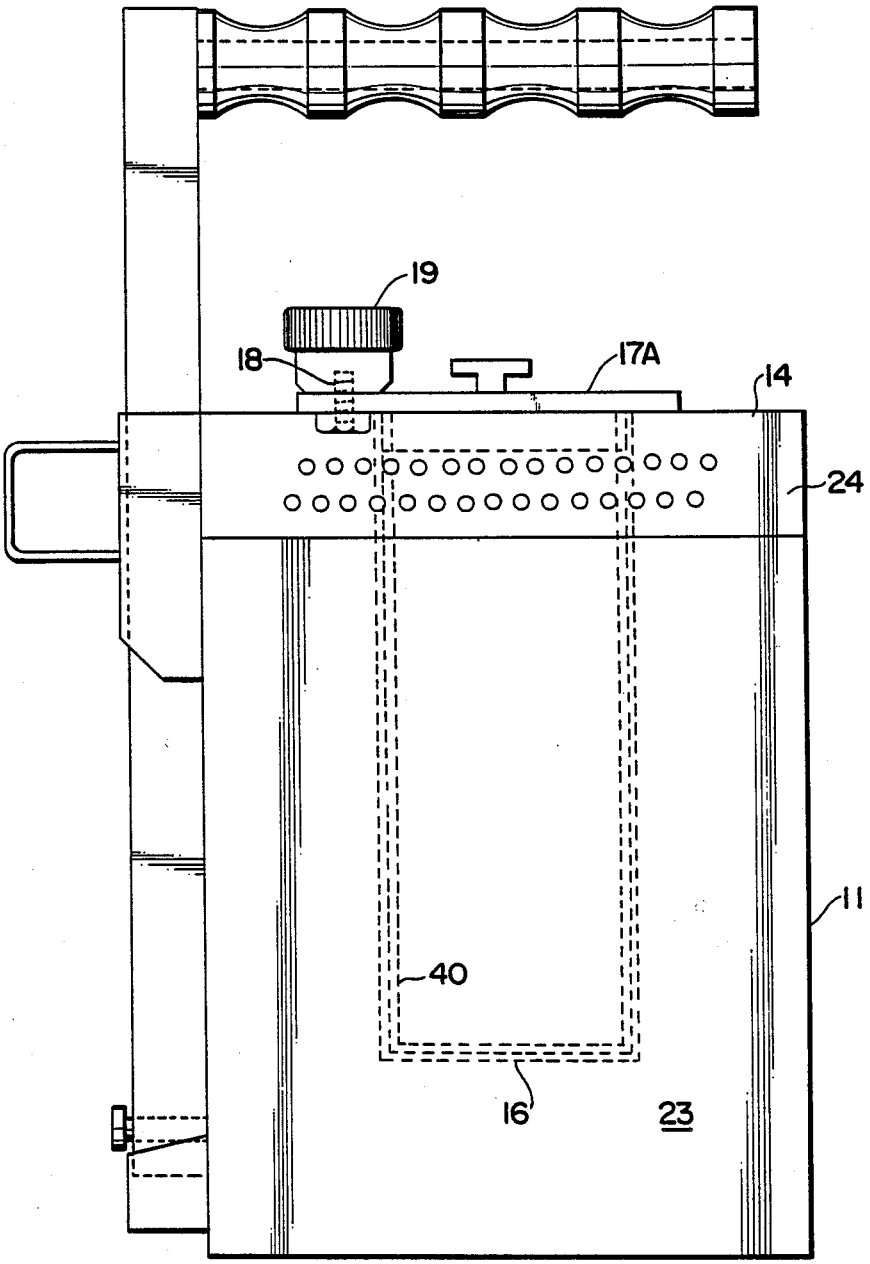
FIG. 4 is a partially schematic side view of another embodiment of the inventive storage and transport containers of the present invention, again showing the relationships of the outer shell, inner well, carrier tube exits and a different embodiment of the well plug member.
Figure 5:
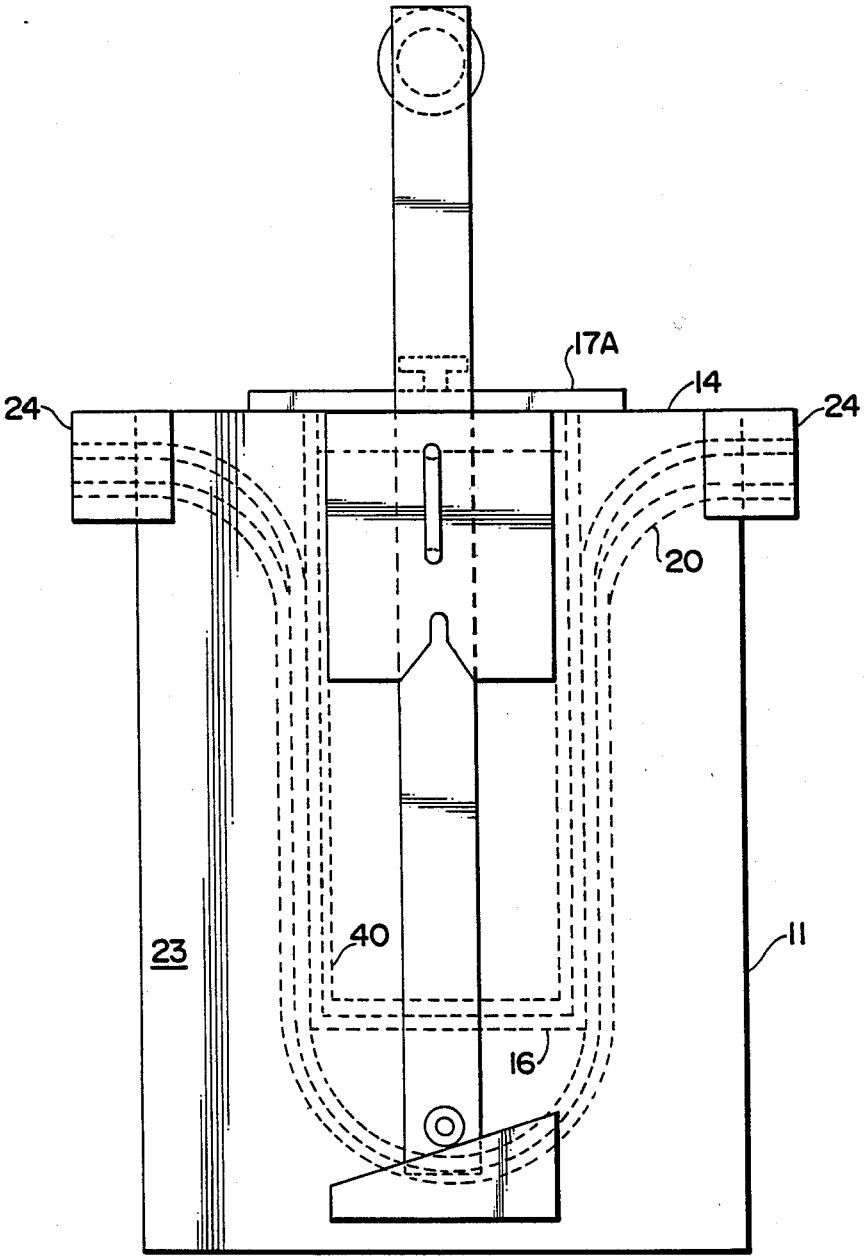
FIG. 5 is another partially schematic side view of the storage and transport container of FIG. 4.

A further embodiment of the advantageous storage and transport containers of the present invention is illustrated in FIGS. 4 and 5. While the embodiment illustrated in FIGS. 4 and 5 has stainless steel side walls 11 and a stainless steel central well or cavity 16 and stainless steel top 14 like the corresponding elements of the embodiment illustrated in FIGS. 1–3, it will be appreciated that the bottom member of the embodiment illustrated in FIGS. 4 and 5 is flat rather than convex as in the embodiment illustrated in FIGS. 1–3, the interior well or cavity is larger and more extensive, and the cap or plug for closure of the well or cavity 16 is much less massive. All of these differences between the embodiment of FIGS. 4 and 5 when compared to the embodiment of FIGS. 1–3 are accommodations to the fact that the embodiment of FIGS. 4 and 5 is intended to be used for storage and transport of radioactive material whose radiation is known to be of relatively low energy as compared with the radioactive materials whose radiation is known to be of relatively high energy which are intended to be stored and transferred in the containers like the embodiment illustrated in FIGS. 1–3. Additionally, the interior 23 of the container illustrated in FIGS. 4 and 5 is not filled with solid lead since the energy of radiation admitted from the materials to be stored and transported therein does not require such heavy duty shielding. Rather, the stainless steel walls which form the container are sufficient to shield radiation emanating from the relatively low energy materials intended to be transported therein.

With respect to the containers described in both FIGS. 1–3 and FIGS. 4 and 5, respectively, the stainless steel sheet material from which the side walls, bottom, top, and internal well or cavity are formed is preferably stainless steel of thickness in the range of about 0.04 to about 0.200 inches. As discussed earlier herein, for use in storing or transporting radioactive material with relatively high energy radiations the interior 22 of containers such as that illustrated in FIGS. 1–3 is filled with solid lead, a heavy duty radiation shielding material. If, in embodiments like that illustrated in FIGS. 4 and 5 intended for storage and transport of radioactive materials with relatively low energy radiations, it is found that the thickness of the stainless steel materials is not entirely adequate shielding for the materials intended to be stored and transported therein, the interior surfaces of the stainless steel portions of the container may be coated or cladded with additional shielding materials. For example, tin, silver, lead, gold, and tungsten are all good radioactive shielding materials. Among those materials, tin is particularly preferred for shielding of low energy radiations at coating or cladding thicknesses of about 0.010 to 0.125 inches. While silver is also adequate for shielding such low energy radiations, it is clear that tin is a much less expensive alternative. For such low energy shielding applications, lead may also be used, but coatings of lead shielding would have to be at least twice as thick as corresponding coatings of tin or silver to achieve the same shielding effectiveness. Gold, like silver, is a very expensive alternative, and tungsten is a material which is difficult to fabricate into thin sheets. Accordingly, tin tends to be the preferred coating material for the addition of shielding effectiveness to containers such as that illustrated in FIGS. 4 and 5. Specifically, a coating of a shielding material such as tin may be added to any of the surfaces of the side walls 11, bottom 13, top 14 or interior well or cavity 16 which face the interior 23 of the container.

Additionally, for containers intended for the storage and transport of radioactive materials with relatively low energy radiations, the cap or plug 17 for the internal cavity or well 16 may be much less massive and may be formed of a variety of suitable shielding materials. For example, cap 17A in the embodiment illustrated in FIGS. 4 and 5 may be formed of stainless steel, brass or the like. Conversely, where the container is intended for storage and transport of radioactive materials with relatively high energy radiations, as in the case of the container illustrated in FIGS. 1–3, the cap or plug 17 is preferably made of much more heavy duty shielding materials, such as a plug of lead coated or cladded with stainless steel. It will also be appreciated that the plug 17 shown in FIGS. 1–3 is much thicker and more massive than the thinner plug 17A illustrated in the embodiment of FIGS. 4 and 5.

An additional difference between the embodiments of FIGS. 4 and 5 when compared to the earlier described embodiment of FIGS. 1–3 is the fact that the generally U-shaped stainless steel carrier tubes 20 are relatively free standing within the empty interior 23 of the container. In the embodiment of FIGS. 4 and 5 there is no lead filling to maintain the position of the carrier tubes 20 vis-a-vis each other and the interior of the container. Therefore the embodiment of FIGS. 4 and 5 comprises additional tube securing block elements 24 through which the tubes exit on each lateral side of the container, and each such block element is bored on its rear face to receive the outside diameter of each stainless steel tube 20, and drilled on its exterior front face, as illustrated in FIG. 4, to permit a ribbon of radioactive medical treatment material to pass into and out of each stainless steel tube. Blocks 24 may comprise brass or any other readily drillable shielding material. If desired, alpha-numeric indicia, or any other indicia, to separately identify each tube may be added to the exterior surface of blocks 24. Blocks 24 are in turn securely fastened at the junction between the side walls 11 and the top surface 14 of the container illustrated in FIGS. 4 and 5, and when securely fastened and when both ends of tubes 20 are likewise securely fastened to blocks 24, the tubes 20 are substantially securely fixed and positioned within the interior 23 of the container illustrated in FIGS. 4 and 5.

Figure 6:
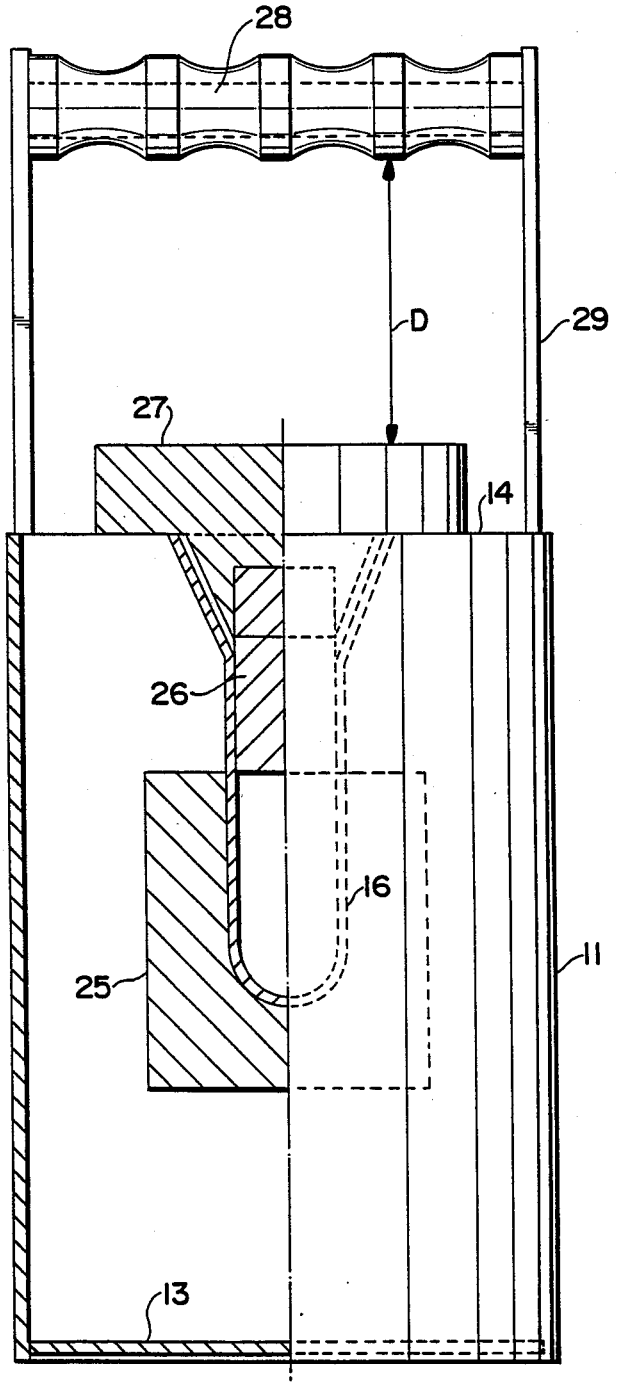
FIG. 6 is a partially schematic side view of a storage and transport container for waste radioactive seeds and ribbons showing in partially cut-away view the outer shell, inner well and dual plug member for the inner well.

The storage and transportation container illustrated in FIG. 6 is intended for storage and transportation of new seeds of radioactive material, or alternatively, waste seeds, pellets, ribbon and other radioactive materials. As shown, this container comprises stainless walls 11 and stainless steel top 14 as well as stainless steel internal cavity or well 16. This more simple device also includes a bottom shielding member 13, which is a flat metallic disc integral with the walls 11.

As shown in the partially cutaway view portion of FIG. 6, the structure of the internal well or cavity and of the plug member of this embodiment are substantially different from corresponding portions of the devices described earlier herein. The internal well 16 exits through the top 14 of the container in a conical funnel-like shape which merges with the remaining cylindrical length of the internal well 16. The bottom of the internal well 16 may be either flat or hemispherical as shown. Additionally, if further shielding is desired, an additional shielding block 25, preferably of tungsten, gold or alloys thereof may be included on the exterior of the stainless steel wall of the interior well 16.

The plug member in this embodiment comprises two connected pieces, the inner most portion thereof being a cylindrical block of tungsten 26, and the outermost portion of the plug comprising an exterior disk of brass having a conical frustrum extending axially downward therefrom, with the cylindrical tungsten plug 26 being integrally attached within a complementary cylindrical space which is coaxial with the conical frustrum portion of plug 27. As combined, the tungsten/brass plug 26, 27 form an effective, massive plug which is easily gravitationally retained in the top of the container thereby minimizing radiation exposure outside of the container during storage and/or transportation of radiation sources. In various embodiments either or both portions of plug 26, 27 may comprise tin, silver, gold, lead, tungsten, copper, iron, nickel, or alloys thereof.

Furthermore, the embodiment of FIG. 6 includes a horizontal handle member 28 which is supported by two stainless steel support arms 29 which are welded to the top surface 14 near the junction of the top surface 14 with the cylindrical sidewalls 11, so that the handle 28 lie substantially in a diametric plane of the cylinder formed by the sidewalls 11. Additionally, the distance D between the upper surface of the plug 27 and the lower surface of handle 28 is such that there is typically just barely sufficent room for the plug 27 to be removed from the top of the container, this relationship helping to eliminate some accidental spillage in the event that the heavy container is accidentally tipped over. In normal usage the distance D will be adequate to permit vertical lifting of the plug 27 and removal of the plug from its position closing the central well or cavity 16.

The above-described unique storage and transportation container for radioactive materials used in medical application, as illustrated in FIG. 6 and explained above, provides a safe, economical and relatively light weight means of storing and transporting such radioactive materials.

Figure 7:
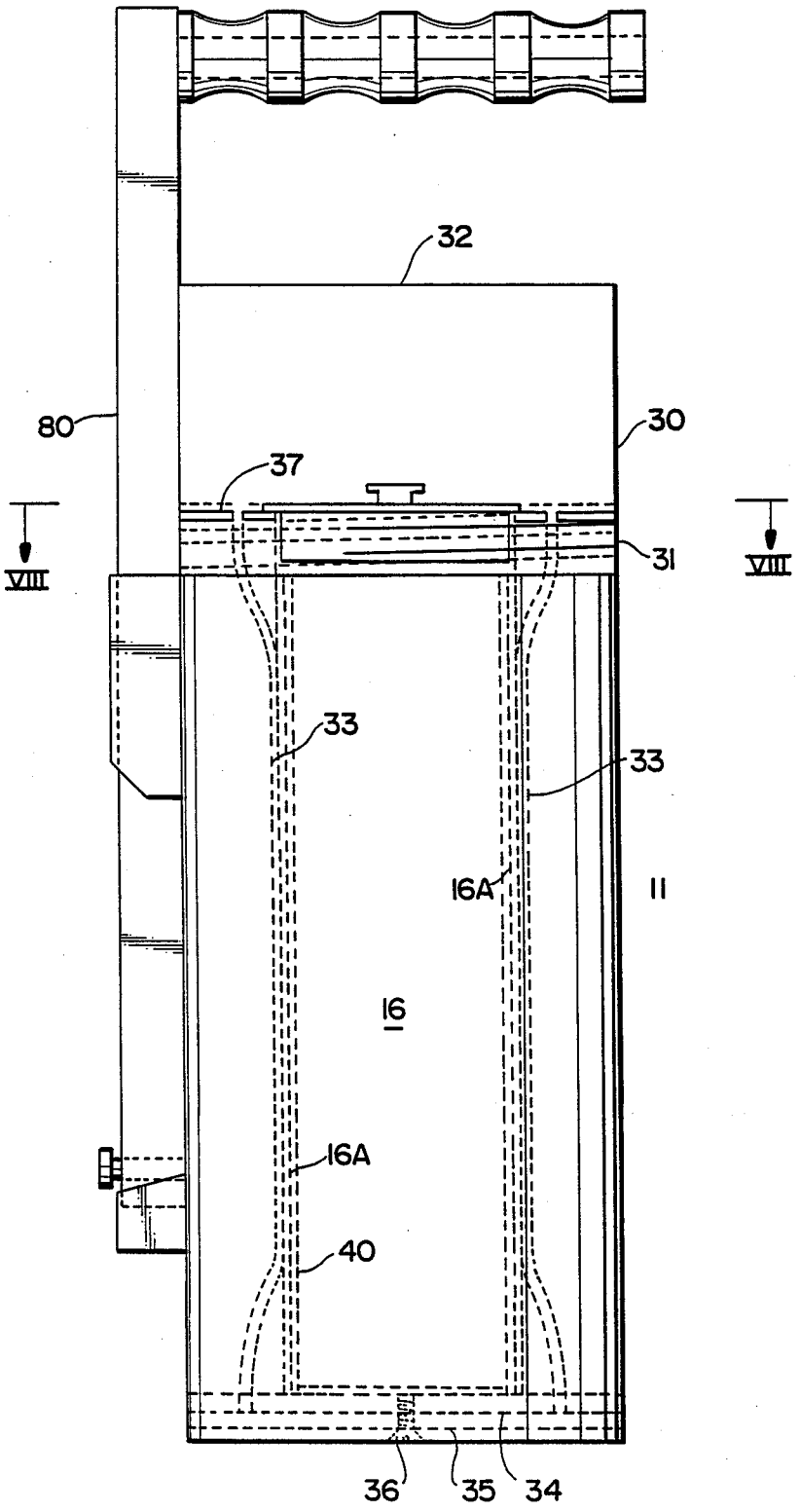
FIG. 7 is a partially schematic side view of another embodiment of the inventive storage and transport containers wherein the inner well extends through the length of the container and the carrier tubes for ribbons of radioactive medical materials extend through the length of the container substantially parallel to the walls of the inner well.
Figure 8:
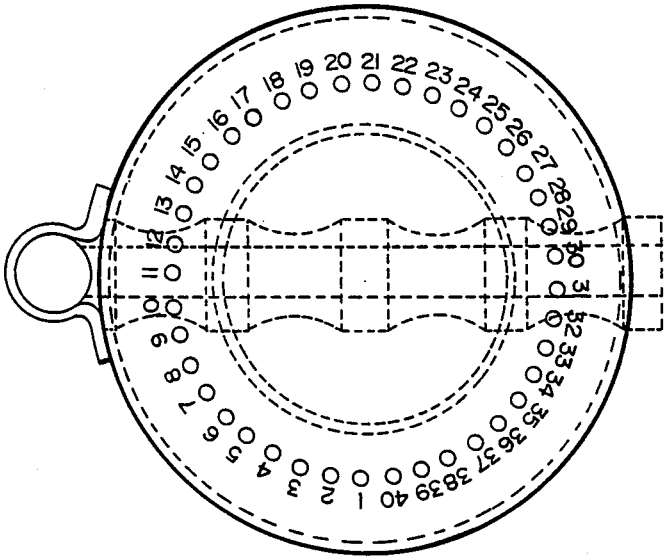
FIG. 8 is a top view of the storage and transport container of FIG. 7, without its cap.

A still further embodiment of the advantageous storage and transport containers for radioactive medical materials is illustrated in FIGS. 7 and 8, this embodiment comprising a primarily cylindrical container having an external stainless steel shell 11 with an extensive cylindrical central well or cavity 16 extending substantially throughout the length of the container. The top of this container comprises a relatively short stainless steel cylindrical cap 30 of the same diameter as the basic stainless steel shell 11 and threadably connected to the top of the basic stainless steel shell 11 by threads on the inside of cap 30 and on the exterior of the top of shell 11, those mating sets of threads here generally designated as threads 31. Stainless steel cap 30 includes a stainless steel top 32 which is welded within the circumference of the exterior shell of cap 30. Internal well or cavity 16 is likewise formed by cylindrical stainless walls 16A and just outside of the cylindrical walls 16A of internal well or cavity 16 are located a plurality of small diameter stainless steel tubes 33 which likewise extend throughout tha length of the container. The ends of those stainless steel tubes 33 are open as they exit each end of the container and, as illustrated in FIG. 7, before exiting at each end of the cylindrical container each tube 33 bends or diverts outwardly from the center of the cylinder to form a lazy S-shaped curve which prevents radiation from materials located in the part of the tube 33 which is parallel to the axis of the cylindrical container from radiating axially in a straight line out of any open exit of any tube 33.

The bottom of the cylindrical container is closed by a further disk of stainless steel 34 through which each tube 33 exits. On the exterior of bottom plate 34 is a further brass cap 35 which is removable by removing screw or bolt 36. Plate 35 affirmatively closes the open end of all stainless steel carrier tubes 33 at the bottom of the container. Similarly, the top of the container includes an internal cap 37 which closes the interior of the well or cavity 16 within the confines of stainless steel threadably engageable cap 30/32. The upper exit ends of each of the tubes 33 may be left open and thus closed or protected only by the stainless steel outer cap 30/32, or, alternatively cap 37 may be designed to cover not only interior well or cavity 16, but also to simultaneously cover the upper open ends of each of the stainless steel carrier tubes 33.

While all of the foregoing elements may be made of stainless steel as indicated above, in some embodiments the walls 16A of interior cavity 16 may be formed of brass tubing and bottom plate 34 may also be formed of brass which is drilled to receive the lower ends of stainless steel tubes 33 at the interior surface of plate 34, and also drilled entirely through the thickness of plate 34 with holes of sufficient diameter to permit entry and exit of ribbons of radioactive medical treatment materials as described above herein. Similarly, the upper end of the cylindrical storage and transport container may comprise an internal plate of stainless steel 37, and may be drilled to receive at its interior surface the ends of stainless steel carrier tubes 33, while including coaxial holes entirely through its thickness to permit entry and exit of ribbons of radioactive medical treatment materials. Furthermore, plate 37 may also be made of brass or other material which may be more workable than stainless steel, but still provides sufficient shielding of the radioactive materials stored in the inventive container. The upper surface of plate 37 may have each of the entry holes for each of the carrier tubes 33 countersunk in a conical or funnel-shaped entryway to facilitate threading of a ribbon of radioactive material into each of the stainless steel carrier tubes 33. As previously noted, plug or stopper 38 may be designed simply to close central cavity 16, or, alternately, may be designed to extend even over the open ends of the stainless steel carrier tubes 33.

While, in the embodiment illustrated in FIG. 7, the stainless steel carrier tubes 33 are illustrated as extending substantially parallel to the axis of the cylindrical container from one end thereof to the other, the stainless steel carrier tubes 33 may be designed to spiral around the cylindrical walls 16A which form the internal cavity 16. In any event, alphanumeric indicia, or any other desired indicia to facilitate positive identification of each of the carrier tubes 33 may be engraved or otherwise placed in or on the surface of plate 34 and plate 37, respectively.

As with the embodiments of the advantageous storage and transport containers of the present invention illustrated in FIGS. 1–3 and 4 and 5, above, the embodiment of FIG. 7 is also shown including the novel handle system 80 of the present invention. FIG. 8 is a top view of the plate 37, stainless carrier tubes 33 and internal well 16 of the cylindrical storage transport container illustrated in FIG. 7. Additionally, it will be appreciated that the storage and container structure described in FIGS. 7 and 8 is primarily designed for the storage and transport of radioactive materials with relatively low energy radiation. If it is found that the thickness of the stainless steel or brass material typically used therein is not entirely adequate shielding for the materials intended to be stored and transported therein, the inner surfaces of the stainless steel or brass portions of the container may be coated or cladded with additional shielding material such at the tin, silver, lead, gold, tungsten or alloys thereof as discussed earlier herein.

Figure 9:
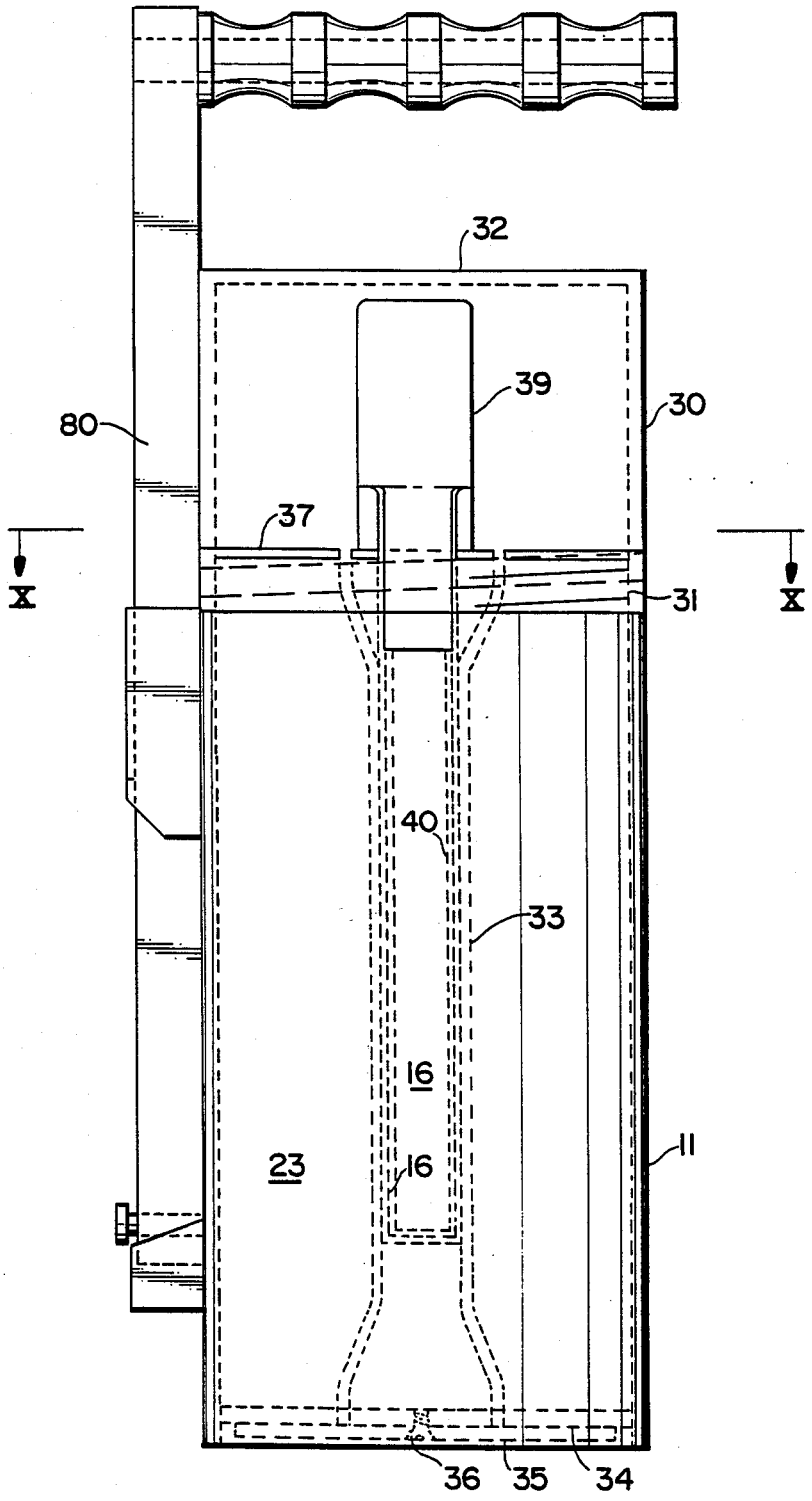
FIG. 9 is a partially schematic side view of another embodiment of the inventive storage and transport containers, somewhat like the embodiment illustrated in FIG. 7.
Figure 10:
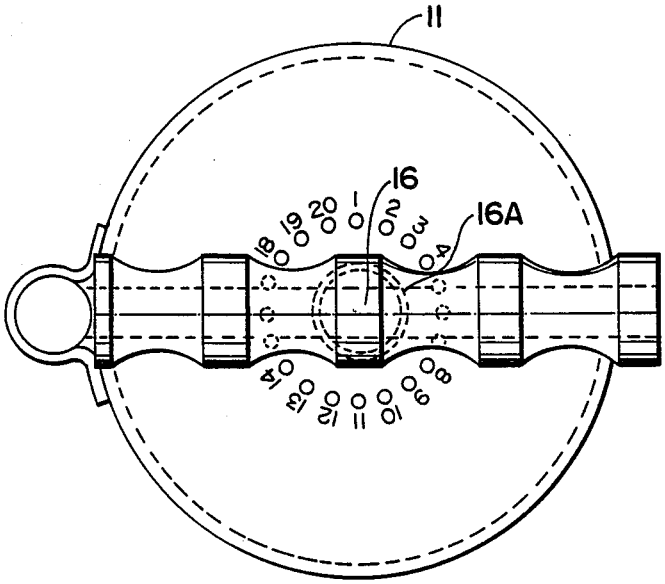
FIG. 10 is a top view of the storage and transport container of FIG. 9, without its cap.

Still another embodiment of the advantageous storage and transport container for radioactive medical materials of the present invention is illustrated in FIGS. 9 and 10. Like the embodiment illustrated in FIGS. 7 and 8, the embodiment illustrated in FIGS. 9 and 10 also preferably comprises a cylindrical shell of stainless steel 11 having a bottom stainless steel member 34 with an additional bottom cap 35 which is attached by a screw of bolt 36. The top of this cylindrical container comprises a stainless steel disk 37 and the cap of the container itself comprises a short stainless steel cylinder 30 of equal diameter with exterior stainless steel shell 11, that short cylinder 30 having a top member of stainless steel 32 welded therewith. The junction between primary stainless steel shell 11 and upper cap shell 30 is achieved through thread here schematically illustrated at 31.

As in the embodiment of FIGS. 7 and 8, the embodiments of FIGS. 9 and 10 include an internal well or cavity 16 formed by a cylindrical stainless steel wall 16A extending coaxially with the stainless steel walls 11 downwardly from top plate 37, but terminating at an appropriate shielding distance from bottom plate 34. The upper open end of this well or cavity 16 is stoppered with an appropriate plug member such as a massive plug of lead coated with stainless steel. Stopper member 39 is illustrated in FIG. 9. When cap 30/32 is in place on shell 11 the spacing between top member 32 and stopper member 39 is such that the stopper member 39 cannot leave the top opening of the central cavity 16.

Stainless carrier tubes 33 are located in a circular array surrounding interior well 16 and each carrier tube 33 extends from an upper open end which is accessible through upper stainless steel plate 37 through lower plate 34. Each of plates 34 and 37 are bored to receive the ends of the stainless steel carrier tubes 33 and through-bored to permit passage of ribbons of radioactive materials to enter and exit each end of each of the tubes 33. As in the embodiment of FIGS. 7 and 8, the lower exit ends of tube 33 are affirmatively closed by cap 35 which is maintained in place by screw or bolt 36. Also as in the embodiment of FIGS. 7 and 8 the upper ends of tubes 33 may be formed with an entry funnel countersunk into the upper surface of plate 37 to facilitate entry of ribbons of radioactive material into each of the carrier tubes 33. FIG. 10 comprises a top view of the primary cylinder of the container of FIG. 9 which show the arrangement of the upper opening of each of the carrier tubes 33 around the cylindrical well or cavity 16.

As in the other embodiments of the advantageous storage and transport containers, the present invention, the embodiment of FIGS. 9 and 10 includes handle system 80.

Additionally, the storage and transport container of FIGS. 9 and 10 is intended for the storage and transport of relatively high energy radioactive material, and thus the internal cavity 23 of the container illustrated in FIGS. 9 and 10 is filled with solid lead, or any other suitable heavy duty radioactive shielding material. That lead filling not only surrounds the central well or core 16, but also surround the carrier tubes 33 and fills the space beneath the internal well 16 and between the lower ends of the carrier tubes 33. As in the embodiment of FIGS. 1–3, the filling of lead shielding material tends to help stabilize the position of tubes 33 within the cylindrical container. However, since both ends of each carrier tube 33 are also affixed to bottom and top plates 34 and 37, respectively, even in the embodiment of FIGS. 8 and 9 those carrier tubes are quite adequately affixed in place.

In use, it has been found that the advantageous storage and transport containers for radioactive medical materials of the embodiments illustrated in FIGS. 7 and 8 and FIGS. 9 and 10, respectively, are particularly advantageous because they may be opened, have the bottom caps 35 removed, and thus readily facilitate movement of a ribbon of radiocactive material stored in any one of the tubes 33 through pushing impetus through top plate 37 through top plate 37 thereby pushing the ribbon of radioactive material out through bottom plate 34 whereupon the ribbon may be fed directly into a dosage tube already implanted in a patient's body.

It will also be clear to those skilled in the art that the function of the internal well 16 in the embodiments of FIGS. 7–10 are for the same purpose as the central well in the earlier embodiments, namely the storage and transport of waste radioactive materials used or for use in medical applications. It will be appreciated, however, that in the embodiments of FIGS. 7–10, the capping or plugging of the central wells for waste of radioactive material is doubly secure because of the additional presence of screw-fitted caps 30/32. Furthermore, the additional space within screw-fitted caps 30/32 may be used for storage and transportation of some higher volumes of radioactive waste material, provided that the shielding thickness of the stainless materials from which caps 30/32 are formed are adequate to shield any material sought to be stored and transported therein.

The overall dimensions of the storage and transport containers of the present invention are typically such that one person can safely handle the container. For example, such containers might have widths of about 1–20 inches, similar depths, and heights of about 2–24 inches, depending upon the desired end use.

Finally, each of the embodiments of FIGS. 1–3, 4–5, 7–8 and 9–10 includes unique handle structure 80 which is another important aspect of the storage and transport containers of the present invention. While the handle system 80 is here described specifically in conjunction with storage and transport containers for radioactive medical materials, it should be understood that the unique handle structure of the present invention may be used in conjunction with handling, lifting, and transporting any desired object or container. Perhaps that handle structure is best illustrated in FIGS. 1–3, reference to which is hereafter made in detail with appropriate reference numerals.

The handle structure 80 comprises a substantially vertical shaft 81 whose length need be no more than about the height of the container 10, or other object with which the handle is associated. The substantially vertical shaft 81 of the handle is retained on the container 10 by a bracket 82 which is sufficiently close fitting around the circumference of the shaft 81 to maintain that shaft in substantially vertical position, but there is sufficient spacing between the shaft 81 and the interior of bracket 82 so that shaft 81 may be raised and lowered substantially vertically within the bracket and shaft 81 may be rotated so that substantially horizontal hand piece 83, which is preferably located diametrically across the top of the container when in position for lifting the container, may be rotated to positions wherein hand piece 83 is not located over the top of the container and thus in no way impairs removal or replacement of the stopper 17.

Shaft 81 also carries, at its lower end on the side of the shaft diametrically opposite from the side from which hand member 83 extends, a small pin 84 which helps control the orientation of the handle when the handle is in either its fully raised or fully lowered positions. When the shaft 81 of the handle is fully raised, pin 84 slidingly engages within recess 85 which is formed in the lower edge of the outermost portion of bracket 82. The cooperation of pin 84 when located in recess 85 causes hand piece 83 affirmatively to be oriented diametrically across the top of the container 10 as even more clearly illustrated in FIGS. 2 and 3. In this position, the hand piece is raised so that a substantial portion of the length of the shaft 81 extends above bracket 82 so that hand piece 83 is then substantially spaced well above the top of the container thus providing an additional margin of safety for any person carrying the advantageous storage and transport containers for radioactive medical materials.

Further, when shaft 81 is lowered into its lowermost position pin 84 interacts with the inclined top surface 87 of lower support member 88 so that the shaft 81 and associated hand piece 83 are gravitationally urged to rotate clockwise when viewed from the top of the container as illustrated in FIG. 3 thus tending to rotate hand piece 83 away from its weight bearing position diametrically across the top of the container to a storage position, illustrated in phantom lines at position 84A in FIG. 3. It will be appreciated that in the position 83A not only is the handle member 83 no longer blocking easy access, removal or replacement of plug 17, but also the handle is in its lowermost position which requires minimal packing space or shelf space necessary for convenient storage of one or a substantial number of the advantageous storage and transport containers for radioactive medical materials according to the present invention.

Lower support member 88, as well as bracket 82, have a substantially U-shaped cross-section with substantial side members extending from each side of the top of the U-shape, as illustrated in the top view of FIG. 3. However, as illustrated in FIG. 2, the top surface 87 of the lower support member 88 lies in an inclined plane whose height decreases from right to left, so that the portion of that surface which corresponds to the bottom half of the U-shape in fact forms a partial spiral surface which promotes reorientation of hand piece 83 from its load bearing position diametrically across the container to its storage position 83A substantially parallel to the side of the container to which it is attached. That declining/spiral surface interacts with the preferably round shaft of pin 84 to minimize the friction between pin 84 and declining surface 88 to permit the desired reorientation of the handle as a whole.

It will be appreciated that the handle systems 80 illustrated in conjunction with the further embodiments shown in FIGS. 4–5, 7–8 and 9–10 are constructed in a manner substantially as just described in conjunction with the embodiment shown in FIGS. 1–3, and those handle members function in substantially the same way as explained with respect to the handle member illustrated in FIGS. 1–3.

While the foregoing descriptions of the advantageous storage and transport containers for radioactive medical materials and associated handle structure have described various embodiments thereof with various materials, thicknesses, sizes and orientations, it will be appreciated by those skilled in the art that various modifications can be made in such containers and handle structures without departing from the scope or spirit of the invention as claimed in the following claims.

What is claimed is:

1. A handle mechanism for an object to be lifted, comprising:

a substantially vertical support shaft having a substantially horizontal hand piece extending from one side of the top of the vertical support shaft;

a pin member extending a short distance outwardly from the side of the bottom end of the vertical support shaft opposite the side thereof from which said hand piece extends;

upper bracket means for attachment to a substantially vertical side of an object to be lifted and for maintaining said support shaft in substantially vertical position, said upper bracket means having an opening through which said support shaft passes, said opening being sufficiently small to maintain said shaft in substantially vertical position, but still permit said shaft to rotate within said opening, said upper bracket means being of sufficient strength to permit lifting of an object when said handle member is raised to that the pin at the lower end of the shaft stops in engagement with the lower surface of the upper bracket means for transmitting lifting force through said handle to an object to which said upper bracket means is attached;

lower stop bracket means for limiting downward movement of the support shaft;

wherein said lower stop bracket includes a top surface which slopes downwardly from one side to the other of said lower stop bracket forming an incline plane upon which the pin in the bottom of the vertical shaft can travel functioning as a cam-follower for orienting the rotation of the vertical shaft in a direction wherein the handpiece is directed substantially parallel to the side of the object to which the handle means is to be attached.

2. The handle apparatus of claim 1 wherein said lower bracket comprises a generally U-shaped cross section having substantial flange portions extending laterally from the top of each vertical arm of the U, said flange portions for attachment to an object to be lifted by the handle, and the top surface of the lower stop bracket forms a partial spiral surface for following by the pin in the bottom of the vertical handle member.

* * * * *